United States Patent [19]

Holyoak

[11] Patent Number: 4,734,235

[45] Date of Patent: Mar. 29, 1988

[54] AERATOR

[76] Inventor: H. Ken Holyoak, Box 449, Alapaha, Ga. 31622

[21] Appl. No.: 934,441

[22] Filed: Nov. 24, 1986

[51] Int. Cl.[4] ..... B01F 3/04

[52] U.S. Cl. ..... 261/91; 261/120; 210/242.2

[58] Field of Search ..... 261/91, 120; 210/242.2

[56] References Cited

U.S. PATENT DOCUMENTS

| | | | |
|---|---|---|---|
| 3,101,173 | 8/1963 | Jennings | 261/91 |
| 3,218,042 | 11/1965 | Ciabattari et al. | 261/120 |
| 3,235,877 | 2/1966 | Grob | 261/120 |
| 3,496,901 | 2/1970 | Stanfield et al. | 261/91 |
| 3,497,185 | 2/1970 | Dively | 261/120 |
| 3,524,629 | 8/1970 | Culwell | 261/91 |
| 3,704,868 | 12/1972 | Weis | 261/91 |
| 4,193,951 | 3/1980 | Stanley | 261/120 |
| 4,242,199 | 12/1980 | Kelley | 261/91 |
| 4,350,648 | 9/1982 | Watkins, III et al. | 261/120 |

FOREIGN PATENT DOCUMENTS

| | | | |
|---|---|---|---|
| 2428462 | 2/1980 | France | 210/242.2 |
| 2138692 | 10/1984 | United Kingdom | 261/91 |

*Primary Examiner*—Tim Miles

*Attorney, Agent, or Firm*—Newton, Hopkins & Ormsby

[57] ABSTRACT

An aerator for oxygenating the water in a pond or the like is disclosed, the aerator having a housing with a floatation collar therearound and a motor disposed in a vertically adjustable bracket mounted in the housing. A propeller is secured to the motor shaft and the bracket is adjusted so as to dispose most of the propeller above the surface of the water to create a flow of water from lower levels of the pond through the housing, during operation of the aerator. The propeller is designed to increase agitation, having straightened blade ends and notches cut in the blades, the agitation and spray serving to oxygenate the water and to allow harmful gases to escape to the atmosphere.

15 Claims, 3 Drawing Figures

AERATOR

BACKGROUND OF THE INVENTION

Aeration of the water in ponds, lakes, and other bodies water is essential for providing an environment which will support aquatic creatures and plants. The dissolved oxygen supply in such bodies of water is continuously being used by fish, plants, etc. to not only sustain life but to remove waste products formed by decaying organic material and waste products from live organisms.

Dissolved oxygen is removed from the water by these living organisms and replenished by aquatic plants undergoing photosynthesis. As photosynthesis occurs, the plants give off oxygen and use carbon dioxide. As the plants or other aquatic life thrive, more waste products are produced which in turn, raises the biological and chemical oxygen demand. Where the growth rate is rapid, and sunlight cannot reach the organisms, no photosynthesis occurs and less oxygen is produced to help the indigenous flora degrade harmful by-products such as ammonia, methane, etc.

This is especially important in establishments such as fish hatcheries, where oxygen stress makes the fish more susceptible to disease and parasites. Fish may also be killed due to the low oxygen/high ammonia concentration, where the oxygen concentration drops below three or four parts per million. Proper oxygenation also reduces over concentration of algae and decaying matter which can cause musky smells surrounding ponds and an off-flavor in fish.

SUMMARY OF THE INVENTION

It is, therefore, one of the principal objects of the present invention to provide an aerator which replenishes depleted concentrations of oxygen and maintains oxygen supply at an optimum level for fish or other aquatic life production.

Another object of the present invention is to provide an aerator which is easily adjusted to raise or lower the propeller to produce an optimum spray pattern and protect the motor and which is energy efficient since most of the propeller is disposed above the water level.

A further object of the present invention is to provide an aerator having a propeller specifically designed to introduce oxygen into the water and to provide maximum water displacement.

A still further object is to provide an aerator which is easily installed and maintained and which is durable to provide a long service life.

These and additional objects are attained by the present invention which relates to an aerator having a housing member designed to receive a collar means therearound for suspending the housing member in a body of water. A bracket means is secured inside the housing member for receiving a motor means, the bracket means having an adjustment means associated therewith for raising or lowering the motor relative to the housing member and the water level. The motor operates a propeller means for displacing water and for introducing oxygen into the water.

The propeller means has been specially designed and shaped for maximum water displacement to introduce as much oxygen as is efficiently possible into the water. This is partially a function of the location of the propeller in relation to the water level, thus the adjustment means of the bracket holding the motor is easily adjusted for maximum performance.

Various other objects and advantages will become apparent from the following description, with reference to the accompanying drawings.

DETAILED DESCRIPTION OF THE DRAWINGS

Figure 1:
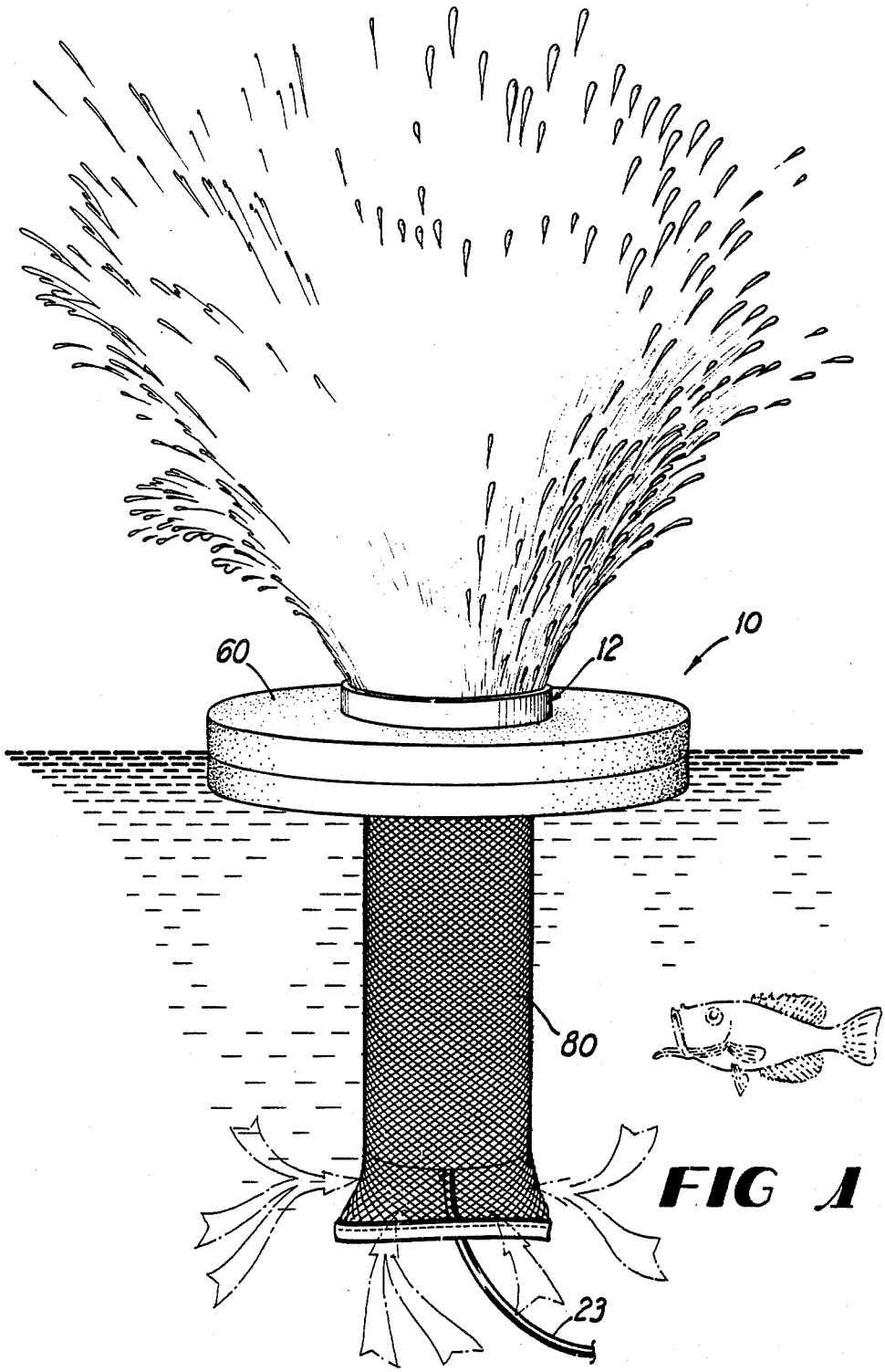
FIG. 1 is a perspective view of the present aerator, shown here in installed position in a body of water.
Figure 2:
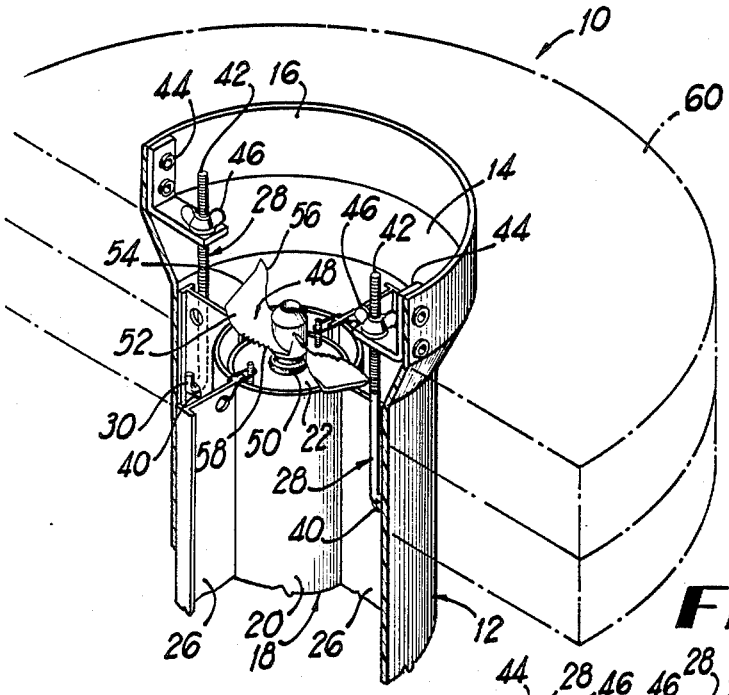
FIG. 2 is a partially cut away, perspective view of the present aerator shown here in installed position and partially in cross-section.

Referring now more specifically to the drawings, and to FIG. 1 in particular, numeral 10 designates generally the aerator, shown here installed in a lake, pond, or the like. The invention is designed to draw water from lower levels of the lake or pond, as indicated by the broken-line arrows, and expel the water upwardly in a variable spray pattern, thereby aerating or oxygenating the water in the pond.

The present aerator has a housing member 12, composed of a non-corrosive material such as a suitable plastic, the housing preferably being a PVC bell tubing. The housing is open at the top and bottom, the top having an outwardly beveled upper flange 14 which merges with a slightly beveled upper rim 16. The beveled upper portion of the housing 12 creates a wide spray pattern, as shown in FIG. 1, the pattern being adjustable relative to the position of the housing in the water, as will be more fully explained hereinbelow.

Mounted inside the housing is a bracket means 18, composed of aluminum or a similar lightweight, non-corrosive material. The central portion 20 of the bracket means is generally cylindrical and hollow for receiving a suitable motor means 22, the motor having a power cord 23 which extends to a suitable power source, (not shown). The motor rests on lugs 24 or other means designed to support the motor within the bracket means. Extending radially outwardly from portion 20 are wing means 26, disposed at approximately ninety degrees relative to one another around the central portion. The wings serve as spacers to keep the bracket and motor centrally disposed in housing 12 and also to receive the adjustment means by which the bracket member and motor may be raised or lowered relative to the housing.

The adjustment means includes a pair of threaded J-hooks 28, having lower hooked ends 30 which are captured within apertures 40 formed in the wings 26. The upper ends 42 of the J-hooks are threaded and are received within L-shaped bracket members 44, which are secured to the upper inside rim 16 of the housing. Wing nuts 46 are threaded onto the upper ends 42 of the J-hooks for adjusting the position of the attached bracket means 18. Thus, the bracket means and motor can be easily and rapidly adjusted vertically in the housing. Similar adjustment means which provide the capability for such facilitated movement may also be employed.

A shaft (not shown) extends axially upwardly out of the motor 22 and receives thereon a propeller 48. The propeller is mounted using an elastomeric bushing or gasket 50 of rubber or other suitable material which is installed over the motor shaft. The gasket provides for a secure, tightly fitting engagement with the propeller on the motor shaft and thereby eliminates the need for an adhesive. If desired, however, a small amount of glue may be spread inside the center portion of the propeller and the propeller is tapped down over the motor shaft until seated. Thereafter, a few drops of glue may be applied to the shaft and allowed to seep downwardly between the shaft and the propeller, thereby completing the assembly.

The propeller is designed to provide maximum agitation of the water. The propeller blades 52 are formed with the outer edges 54 in a relatively straight line configuration to increase the pitch of the propeller and the drag. The uppermost tips 56 of the blades are angled upwardly, also increasing the pitch and directing the water pulled therethrough upwardly through the housing. This configuration contrasts with a normal propeller which is designed to minimize drag, having smoothly rounded contours. The present propeller is designed to increase drag, thereby agitating and displacing a greater amount of water than the standard propeller found on prior art aerators. Futher agitation is provided by a plurality of notches 58 formed in the lower edges of the propeller blades.

The aerator is supported in the water by a suitable floatation collar 60, composed of any suitable material such as a plastic foam, examples including expanded polystyrene or polyethylene material. The collar has an aperture formed therethrough for receiving the housing, the housing being inserted therein bottom first so as to capture and retain the inverted bell-shaped housing.

Secured around the bottom or inlet of the aerator is a guard means, such as a mesh screen 80. The guard is secured to the housing in any suitable manner and denies access to fish, seaweed, or other debris in the water. The guard means is important since the present aerator draws water from approximately 3–4 feet deep while most prior art aerators draw water from the surface. Drawing water from below the surface also affords a particular efficiency advantage with the present aerator in that an aerator drawing water from the surface is aerating water in which oxygen exchange is already taking place, thus duplicating efforts. The present aerator draws water which is de-oxygenated relative to the water on the surface, thereby more quickly aerating the water in the pond and at reduced expense.

Another important feature of the present aerator is the vertical adjustability of the bracket 18, motor 22 and propeller 48 relative to the housing and thus to the water. In general, motors used in aerators are fully submersible and a typical aerator has the entire propeller submerged. The present invention, however, has only the motor and approximately one-eighth inch of the propeller submerged. Thus the propeller is operating substantially above the surface of the water, the extreme bottom of the propeller being the only submerged portion, as indicated by the broken line 82 in FIG. 3.

This provides several additional advantages. The operation of the propeller, with most of the propeller above the water level, causes water to be drawn through the housing as indicated by the arrows in FIG. 1. In contrast, a submerged, spinning propeller creates a vortex that draws water only from the surface. With the propeller substantially above the water line, the aerator operates with a much smaller motor, with reduced energy requirements, and with less wear on the motor than a device in which the propeller is completely submerged. Therefore, similar aeration results can be obtained using the present aerator with a one-third or one-half horsepower motor as are obtained for submerged models using a 1–3 horsepower motor. Of course, the present invention may use any size motor; however, a motor having $\frac{1}{3}$ horsepower, set up as described hereinabove, pumps approximately $\frac{1}{2}$ million gallons in 24 hours. The oxygen transfer rate for the aerator is 38 lbs/$O_2$ in 24 hours.

To achieve the proper level, wing nuts 46 are adjusted on the J-hooks 28, thereby raising or lowering the motor and propeller to a position where approximately $\frac{1}{8}$" of the base of the propeller is in the water. This may be conveniently measured by lowering the motor into the water up to the level of the first three or lowermost notches 58. The adjustment brackets of prior art aerators, if present, are located under the water or the aerator was leveled with bricks, ropes, etc., necessitating their disassembly and removal from the water to adjust the level of the motor and propeller.

The relative size and buoyancy of the floatation collar 60 determines the position of the housing 12 in the water. The upper end or outlet is beveled outwardly to provide a wide spray pattern, as described previously and shown in FIG. 1. The spray pattern may be changed as desired by adjusting the size or buoyancy of the collar, thus, increasing the buoyancy and raising the housing creates a narrower and taller spray pattern. The opposite result is obtained where the buoyancy is reduced. Then, upon installation of the motor or adjustment of the buoyancy of the collar, the level of the motor and propeller may be adjusted to the optimum level with the wing nuts, as previously described.

Figure 3:
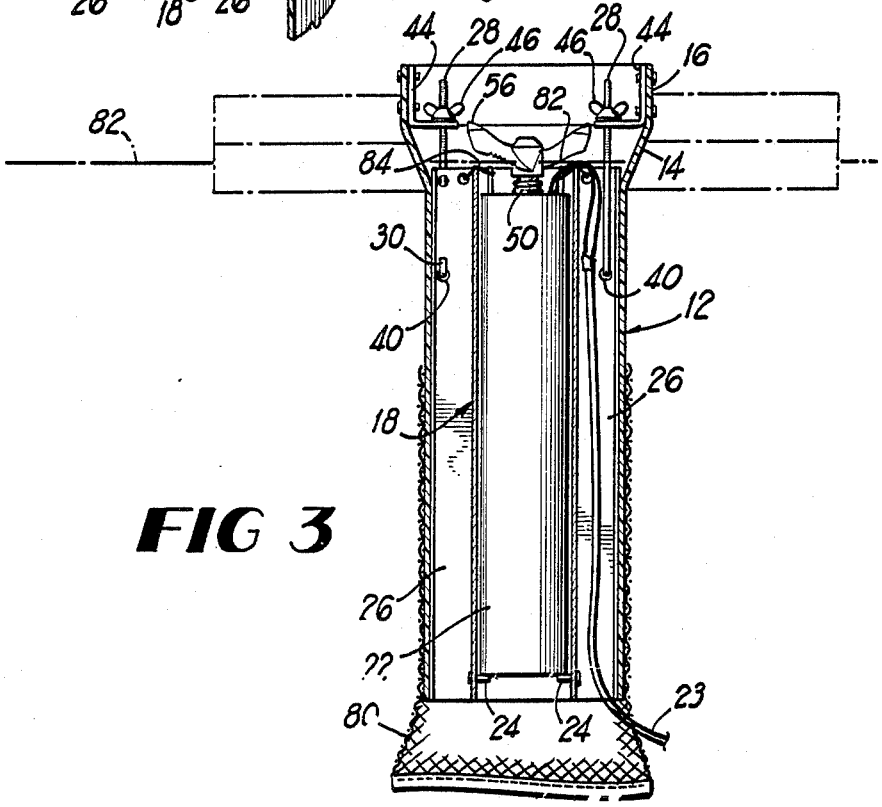
FIG. 3 is a partial, side elevational view of the present aerator having a portion of the housing cut away to show the motor and holding means therefor.

The motor 22, as shown in FIG. 3, is secured in the bracket 18 only by its own weight and with securing ties 84. Thus, should the motor need to be replaced, it is only necessary to unplug the power cord 23, cut the ties 84, and lift the motor and propeller assembly vertically out of the bracket. A replacement motor can then be easily and quickly installed. This feature is also very important since the oxygen level in the water is critical to the survival of fish or plant life and the ability to quickly resume aeration in a distressed pond can make a substantial difference in the survival rate. As noted, an oxygen level below 4 ppm is detrimental to fish. The present aerator easily maintains the oxygen level above 4 ppm, within a safe range of from 4 ppm to 15 ppm.

In the use and operation of the present aerator, the power requirements of the motor are determined and the appropriate connections are made, the motor running on either a 115 or 230 volt AC line 12 volt or the motor may be solar powered with a solar panel, batteries, and the appropriate converter to run the motor on 12 volts DC. With the electric hookup in place, the floatation collar 60 is installed and the mesh guard means 80 is secured around the bottom inlet of housing 12.

The aerator is then placed in water having a depth of at least two or three feet. A rope or other means (not shown) is then attached to each side of the aerator to keep it from spinning during operation, with enough slack left in the ropes to allow the aerator to freely float up or down in response to changes in water level.

With the aerator in place, the adjustment means, comprising the wing nuts on the J-bolts, are loosened or tightened to raise or lower the bracket, motor, and propeller to a point where approximately ⅛" of the base of the propeller is submerged. This provides maximum agitation and consequent oxygenation of water while minimizing energy use. The aerator may then be operated as necessary to maintain the oxygen level in the water at a level safe for fish and plant life.

While an embodiment of an aerator and modifications thereof have been shown and described in detail herein, various other changes and modifications may be made without departing from the scope of the present invention.

I claim:

1. An aerator for agitating and spraying water in a pond or the like for oxygenating the water, comprising a housing member having an inlet disposed below water level and an outlet disposed above water level, said housing member being generally hollow for conducting water therethrough, a bracket means disposed in said housing said bracket means having a central portion with wing means extending radially outwardly from said central portion for maintaining said bracket from in a generally central position with respect to said housing member and having adjustment means operatively connected thereto for vertically adjusting said bracket means with respect to said housing, a motor means having a propeller means mounted thereon and having a power source, said motor means being disposed in said bracket means for agitating the water upon activation of said motor means.

2. An aerator as defined in claim 1 in which said propeller has blades with generally straight outer edges with upturned tips for agitating the water and directing the spray upwardly.

3. An aerator as defined in claim 1 in which said wing means include apertures formed therein for receiving said adjustment means.

4. An aerator as defined in claim 1 in which said outlet of said housing member is beveled outwardly with respect to said inlet and said aerator includes a floatation collar means disposed around said housing member near said outlet for suspending said aerator in the water.

5. An aerator as defined in claim 4 in which said housing member includes a guard means disposed over and around said inlet and secured to said housing member for preventing ingress of foreign material.

6. An aerator for drawing water from below the surface of a pond or the like and agitating and spraying the water into the air for oxygenating the water, said aerator comprising a housing member having an inlet means disposed below the surface of the water and an outlet means disposed above the surface of the water, said housing member being generally hollow for conducing water therethrough, a bracket means disposed in said housing member and having adjustment means operatively connected thereto and to said housing member for vertically adjusting the position of said bracket means relative to said housing member, a motor having a power source and a rotatable shaft, said motor disposed in said bracket means and having a propeller mounted for rotation on said shaft, with said bracket means being disposed by said adjustment means to a position where most of said propeller is above the surface of the water.

7. An aerator as defined in claim 6 in which said propeller has blades with generally straight outer edges with upturned tips for agitating the water and directing the spray upwardly and said blades have a plurality of notches cut the for increasing agitation of the water.

8. An aerator as defined in claim 6 in which said bracket means includes a central portion for receiving said motor means and a plurality of wing means extending radially outwardly from said central portion for maintaining said bracket means in a generally central position with respect to said housing member.

9. An aerator as defined in claim 8 in which said wing means include apertures formed therein for receiving said adjustment means.

10. An aerator as defined in claim 6 in which said outlet of said housing member is beveled outwardly with respect to said inlet and said aerator includes a floatation collar means disposed around said housing member near said outlet for suspending said aerator in the water.

11. An aerator as defined in claim 10 in which said housing member includes a guard means disposed over and around said inlet and secured to said housing member for preventing ingress of foreign material.

12. An aerator for drawing water from below the surface of a pond or the like and agitating and spraying the water into the air for oxygenating the water, said aerator comprising a housing member having an inlet means disposed below the surface of the water and an outlet means disposed above the surface of the water, said housing member being generally hollow for conducting water therethrough, a bracket means disosed in said housing member and having a central portion and a plurality of wing means extending radially outwardly from said central portion for maintaining said bracket means in a generally central position with respect to said housing member, a motor having a power source and a rotatable shaft, said motor disposed in said central portion of said bracket means and having a propeller mounted for rotation on said shaft, with said bracket means being disposed in a position where most of said propeller is above the surface of the water.

13. An aerator as defined in claim 12 in which said propeller has blades with generally straight outer edges with upturned tips for agitating the water and directing the spray upwardly and said blades have a plurality of notches cut therein for increasing agitation of the water.

14. An aerator as defined in claim 13 in which said outlet of said housing member is beveled outwardly with respect to said inlet and said aerator includes a floatation collar menas disposed around said housing member near said outlet for suspending said aerator in the water.

15. An aerator as defined in claim 12 in which said bracket means includes adjustment means operatively connected thereto and to said housing member for vertically adjusting the position of said bracket means relative to said housing member.

* * * * *